US006877960B1

(12) United States Patent
Presz, Jr. et al.

(10) Patent No.: US 6,877,960 B1
(45) Date of Patent: Apr. 12, 2005

(54) LOBED CONVERGENT/DIVERGENT SUPERSONIC NOZZLE EJECTOR SYSTEM

(75) Inventors: Walter M. Presz, Jr., Wilbraham, MA (US); Michael J. Werle, West Hartford, CT (US)

(73) Assignee: Flodesign, Inc., Wilbraham, MA (US)

( * ) Notice: Subject to any disclaimer, the term of this patent is extended or adjusted under 35 U.S.C. 154(b) by 0 days.

(21) Appl. No.: 10/163,483

(22) Filed: Jun. 5, 2002

Related U.S. Application Data

(60) Provisional application No. 60/296,002, filed on Jun. 5, 2002.

(51) Int. Cl.[7] ..... F04F 5/44
(52) U.S. Cl. ..... 417/198; 417/196; 417/183
(58) Field of Search ..... 417/198, 54, 173.151, 417/179.18, 196.187, 183; 60/262, 768, 737–748, 60/770; 239/265.17, 265.19, 265.33

(56) References Cited

U.S. PATENT DOCUMENTS

| | | | | |
|---|---|---|---|---|
| 2,223,242 | A | | 11/1940 | Sweet, Jr. |
| 2,501,276 | A | | 3/1950 | Hickman |
| 2,759,661 | A | | 8/1956 | Noller et al. |
| 3,823,872 | A | | 7/1974 | Frenzl |
| 3,912,469 | A | | 10/1975 | Ewan et al. |
| 3,972,196 | A | | 8/1976 | Silvestri, Jr. |
| 4,141,701 | A | | 2/1979 | Ewan et al. |
| 4,184,806 | A | | 1/1980 | Prinz |
| 4,272,499 | A | | 6/1981 | Cason et al. |
| 4,358,249 | A | | 11/1982 | Hanson |
| 4,379,679 | A | | 4/1983 | Guile |
| 4,586,873 | A | * | 5/1986 | Lepretre et al. ..... 417/54 |
| 4,835,961 | A | * | 6/1989 | Presz, Jr. et al. ..... 60/264 |
| 4,867,918 | A | | 9/1989 | Kiyonaga et al. |
| 4,898,517 | A | | 2/1990 | Eriksen |
| 4,921,886 | A | | 5/1990 | Ewan et al. |
| 4,931,225 | A | | 6/1990 | Cheng |
| 5,061,406 | A | | 10/1991 | Cheng |
| 5,087,175 | A | * | 2/1992 | Raizman et al. ..... 417/196 |
| 5,309,736 | A | | 5/1994 | Kowalski et al. |
| 5,435,127 | A | * | 7/1995 | Luffy et al. ..... 60/204 |
| 5,440,875 | A | * | 8/1995 | Torkelson et al. ..... 60/226.1 |
| 5,509,349 | A | | 4/1996 | Anderson et al. |
| 5,622,655 | A | | 4/1997 | Cincotta et al. |

(Continued)

*Primary Examiner*—Charles G. Freay
(74) *Attorney, Agent, or Firm*—Holland & Bonzagni, P.C.; Donald S. Holland, Esq.

(57) ABSTRACT

An ejector system comprises a lobed, supersonic primary nozzle and a convergent/divergent ejector shroud. The lobed nozzle is just upstream from the ejector shroud, such that there is an annular space between the nozzle and shroud for admitting a secondary flow. In operation, a primary flow of high-pressure steam or air is directed through the primary nozzle, where it is accelerated to supersonic speed. The primary flow then exits the primary nozzle, where it entrains and is mixed with the secondary flow, creating a low pressure region or vacuum. The ejector shroud subsequently decelerates the combined flow while increasing the flow pressure, which increases suction performance and reduces energy loss. Because the primary nozzle mixes the two flows, the ejector shroud is able to have a length-to-entrance-diameter ratio significantly smaller than typical shrouds/diffusers, which decreases the system's size and increases performance.

18 Claims, 5 Drawing Sheets

U.S. PATENT DOCUMENTS 5,820,353 A 10/1998 Beylich et al.
5,857,838 A 1/1999 Wagner, Jr.
5,884,472 A * 3/1999 Presz et al. ..... 60/262
6,082,635 A * 7/2000 Seiner et al. ..... 239/265.19
6,082,713 A 7/2000 King
6,155,796 A * 12/2000 Schmalz et al. ..... 417/187

* cited by examiner

LOBED CONVERGENT/DIVERGENT SUPERSONIC NOZZLE EJECTOR SYSTEM

This application claims the benefit of U.S. Provisional Application Ser. No. 60/296,002, filed Jun. 5, 2002.

FIELD OF THE INVENTION

The present invention relates to steam/air ejectors and ejector vacuum systems.

BACKGROUND

Many testing and manufacturing processes require vacuum or low-pressure environments. Some of these include jet engine simulations, salt water distillation, food processing, and many chemical reactions. Steam ejectors are often used to create this low-pressure region, and can vary in size from a 0.5 in. (12.7 mm) ejector for use with fuel cells to a 40 ft. (12 m) ejector for use in metal oxidation.

An ejector is a fluid dynamic pump with no moving parts. As shown in FIG. 1 (labeled as "Prior Art"), a typical ejector 30 comprises a primary nozzle 32 and a mixing duct 34 downstream from (and generally axially aligned with) the primary nozzle 32. The ejector 30 uses a high velocity core flow 36, typically air or steam, to entrain a secondary, ambient flow 38, which can be a gas, liquid, or liquid/solid mix. In operation, the high velocity core 36, moving in the direction indicated, creates a low pressure region 40 which sucks in the ambient flow 38. As a result, the primary and secondary flows mix to an extent, and the pressure increases and then reaches ambient conditions at the exit end of the mixing duct 34. Ejectors can be used as pumps (i.e., specifically for moving the secondary flow), or they can be used for purposes of creating low-pressure or vacuum regions (moving the secondary flow reduces the pressure upstream from where the secondary flow is drawn into the mixing duct). The key performance factor for suction ejector systems is the vacuum they can generate while pumping a required load (secondary flow).

A supersonic steam ejector system, an example of which is shown in FIG. 2 (labeled as "Prior Art") is a relatively common type of ejector system that operates at extremely high pressure. The steam ejector system 42 uses a choked, converging/diverging, round primary nozzle 44 in conjunction with a convergent/divergent diffuser or ejector 46 (acting in place of a mixing duct 34). In operation, once a primary steam flow 48 leaves the nozzle 44, it supersonically expands out to the area of the diffuser 46. The primary flow then mixes with the entrained secondary flow 50. The mixed flow then passes through the diffuser 46, which reduces the flow's velocity and increases its pressure by the time the flow reaches the diffuser exit, with the higher the exit pressure, the lower the energy lost. For this purpose, the diffuser 46 has three regions: a supersonic diffuser portion 52 with a converging cross-sectional area; a throat portion 54 with a constant cross-sectional area; and a subsonic diffuser portion 56 having a diverging cross-sectional area.

The problem with steam ejector systems is that they are very expensive to fabricate and operate. More specifically, because a long mixing region is needed, the length of the diffuser 46 is very long—oftentimes 3 ft. (1 m) or more. This results in significant material and manufacturing costs. Moreover, the high-pressure steam jet required to produce the vacuum results in high operational costs. These problems are compounded where multiple steam ejector systems are put in series to increase vacuum capability.

Accordingly, it is a primary objective of the present invention to provide a significantly shortened, less expensive air or steam ejector vacuum system with improved vacuum/pumping performance.

SUMMARY

A lobed, convergent/divergent, supersonic nozzle steam ejector or vacuum system (hereinafter, "ejector system") comprises a lobed, supersonic primary nozzle and a convergent/divergent ejector shroud or diffuser that has a length-to-entrance-diameter ratio significantly smaller than typical shrouds/diffusers, e.g., about 3.5 as compared to 10. The lobed nozzle and ejector shroud both have specially shaped axial through-bores, and are generally coaxial. Also, the lobed nozzle is located just upstream from the ejector shroud, such that there is an annular space or opening between the nozzle and shroud for admitting a secondary flow, which may be channeled to the opening via a conduit, duct, or the like.

In operation, a primary flow of high-pressure steam or air is directed through the lobed primary nozzle, where it is choked and accelerated to supersonic speed. The primary flow then exits the lobed primary nozzle, where it entrains, or drags along, the secondary flow entering through the annular opening or space. As it does so, the lobed primary nozzle rapidly and thoroughly mixes the primary and secondary flows, which pass into the ejector shroud. The ejector shroud subsequently decelerates the combined flow while increasing the flow pressure, which increases suction performance and reduces energy loss. Because the lobed primary nozzle mixes the primary and secondary flows, an inner shroud wall boundary layer is energized, and any ejector shroud diffuser thereby can have steeper inner wall angles and is able to have the significantly smaller length-to-entrance-diameter ratio. The shorter length further enhances suction performance because of reduced wall friction effects. A low pressure or vacuum region is created upstream of the secondary flow by virtue of the primary flow entraining the secondary flow.

BRIEF DESCRIPTION OF THE DRAWINGS

These and other features, aspects, and advantages of the present invention will become better understood with respect to the following description, appended claims, and accompanying drawings, in which:

DETAILED DESCRIPTION

Figure 1:
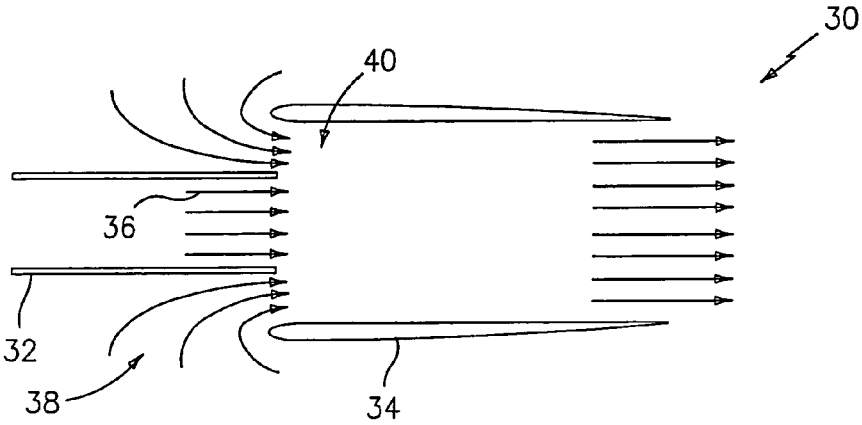
FIG. 1 (PRIOR ART)
FIG. 1 is a schematic, cross-sectional view of an ejector system according to the prior art.

Turning now to FIGS. 3–10, various embodiments of a lobed, convergent/divergent, supersonic nozzle steam ejector or vacuum system 100 (hereinafter, "ejector system"), according to the present invention, will now be described. In a preferred embodiment, with reference to FIG. 3, the ejector system 100 comprises a lobed, supersonic primary nozzle 102 and a "shortened" convergent/divergent ejector shroud or diffuser 104 (by "shortened," as discussed further below, it is meant that the shroud has a shroud-length-to-entrance-diameter ("SLED") ratio significantly smaller than typical shrouds/diffusers, e.g., about 3.5 as compared to 10). The lobed nozzle 102 is positioned just upstream from the ejector shroud 104. In operation, a primary flow 106 of high-pressure steam or air is directed through the nozzle 102 and into the ejector shroud 104. The primary flow 106 entrains, or drags along, a secondary flow 108 as it enters the shroud. As it does so, the lobed nozzle 102 rapidly mixes the primary and secondary flows, allowing the ejector shroud 104 to decrease the velocity and increase the pressure of the combined flows in a very short distance, with improved overall performance.

Figure 4A:
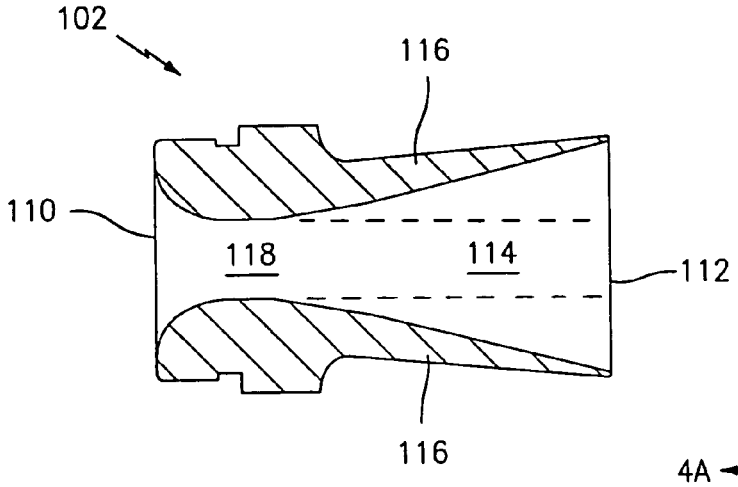
FIG. 4A is a cross-sectional view, taken along lines 4A—4A in FIG. 4B, of a supersonic, lobed primary nozzle portion of the present invention.
Figure 4B:
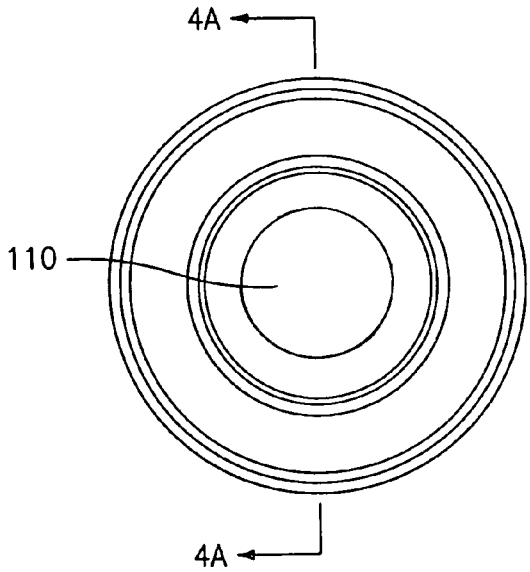
FIG. 4B is an entrance-end view of the lobed primary nozzle.

FIGS. 4A–4E show the lobed primary nozzle 102 in more detail. The nozzle 102 includes an upstream, fore opening 110 (FIG. 4B), and a downstream, aft opening 112 (FIG. 4D), which are connected by an axial passage 114. The nozzle 102 also has eight canted, convergent/divergent lobes 116 for mixing primary flow with secondary flow, and which define the aft opening 112 of the nozzle 102. Note that the lobes 116, portions of which would potentially be viewable from the perspective of FIG. 4B, are not shown in that figure for purposes of clarity. Instead, FIGS. 4A and 4C–4E should be referenced for viewing the lobes 116. Exemplary proportional dimensions for the nozzle 102 which have been found to provide suitable performance are as follows, but other dimensions/proportions are possible as well: $\beta_1$=7.4°; $\beta_2$=5.0°; $\beta_3$=14.2°; $\beta_{4=}$ 2.1°; L1=0.2 units; R1=1.1 units; and R2=0.5 units.

The primary nozzle 102 has the same area distribution as existing suction system nozzles: a convergent/divergent area distribution with axial length. Put another way, for a given application, the area of the aft opening 112 of the nozzle 102 should be about the same as the exit area of the conventional round nozzle it replaces. In use, as the primary flow 106 passes through the primary nozzle 102, the flow 106 is choked in the nozzle's minimum area throat region 118, and reaches Mach 1. After choking, the flow 106 enters a divergent section defined by the lobes 116, which terminates at the nozzle's aft opening 112, and becomes supersonic. This means that the primary flow 106 is supersonic and expanding when it encounters the lobes 116 (i.e., the lobed nozzle contour develops while the flow is supersonic and expanding). While it is generally believed by those in the art that this will generate shockwaves and large losses, no such losses actually occur as a result of three-dimensional flow relief at each flow section.

Turning back to FIG. 3, the ejector shroud 104 is generally cylindrical and includes three regions: a supersonic diffuser 120 with a converging cross-sectional area; a throat 122 with a constant cross-sectional area; and a subsonic diffuser 124 having a diverging cross-sectional area. Together, the supersonic diffuser, throat, and subsonic diffuser define an axial passage extending through the shroud 104, with the supersonic diffuser 120 defining a fore opening and the subsonic diffuser 124 defining an aft opening. Exemplary relative or proportional dimensions (with reference to FIG. 3) which have been found to provide suitable performance are as follows, but other dimensions/proportions are possible as well: Shroud Length SL=11.6 units; Convergent Diffuser Length CDL=4.9 units; Throat Length TL=2.1 units; Throat height or Diameter TD=2.1 units; Entrance height or Diameter ED=3.3 units; eXit height or Diameter XD=2.9 units; distance from Nozzle to Shroud NS=0.3 units; and inner wall angle $\alpha_2$=5.0°.

Figure 5:
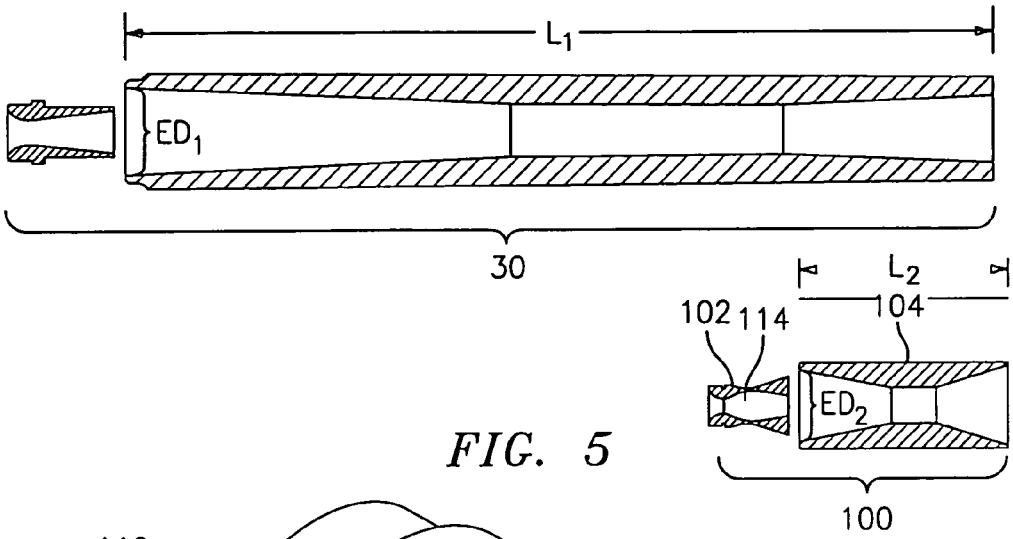
FIG. 5 is a size comparison between existing ejector systems and the ejector system according to the present invention.
Figure 4E:
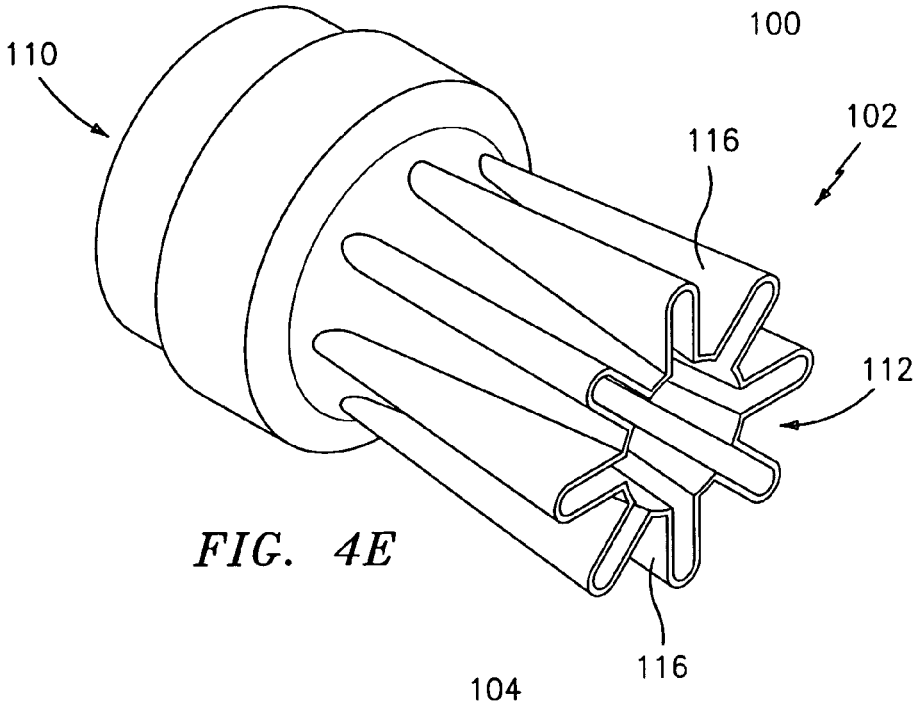
FIG. 4E is a perspective view of the primary nozzle.
Figure 8A:
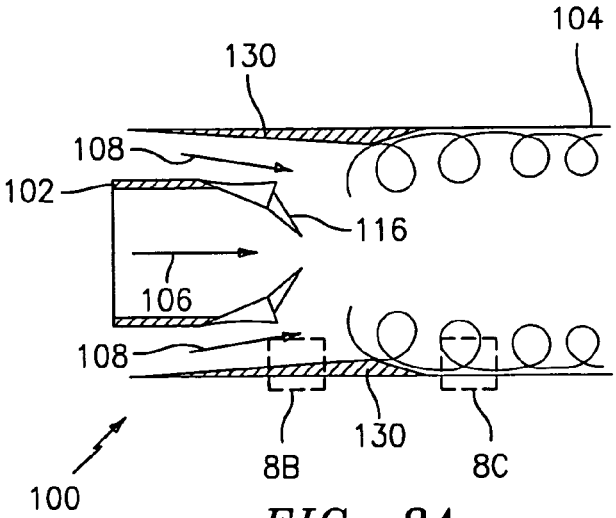
FIGS. 8A–8C are schematic views showing the lobed primary nozzle energizing a flow boundary area in the ejector shroud, thereby reducing or eliminating flow reversal, and allowing for steeper shroud diffuser wall angles.
Figure 8B:
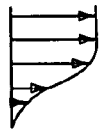
Figure 8C:
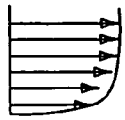

With the lobed primary nozzle 102 in place, the ejector shroud 104 can be shortened. As mentioned above, this means that the ejector shroud 104 has a SLED ratio (shroud-length-to-entrance-diameter ratio) significantly smaller than typical shrouds/diffusers. FIG. 5 shows a scaled comparison between a typical steam ejector system 42 and an ejector system 100 according to the present invention, where L is the shroud length and ED is the entrance diameter. The former has a SLED ratio of about 10, while the latter has a SLED ratio of about 3.5 (i.e., between 3 and 4). Testing has indicated that lower ratios of from about 1.0 to below 3 are suitable as well. However, performance has been found to drop significantly when SLED ratios are below about 1.0. Additionally, providing a longer length for a given entrance diameter, thereby increasing the SLED ratio above about 3.5, may improve performance. However, a ratio of about 3.5 (i.e., between 3 and 4) provides a good balance between compactness (and associated reduced material and manufacturing costs) and equal/improved performance.

Figure 2:
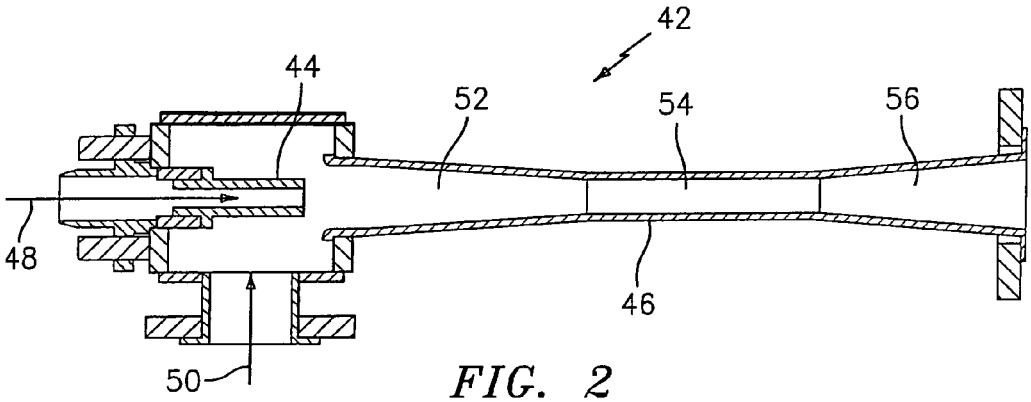
FIG. 2 (PRIOR ART)
FIG. 2 is a cross-sectional view of a steam ejector system according to the prior art.
Figure 3:
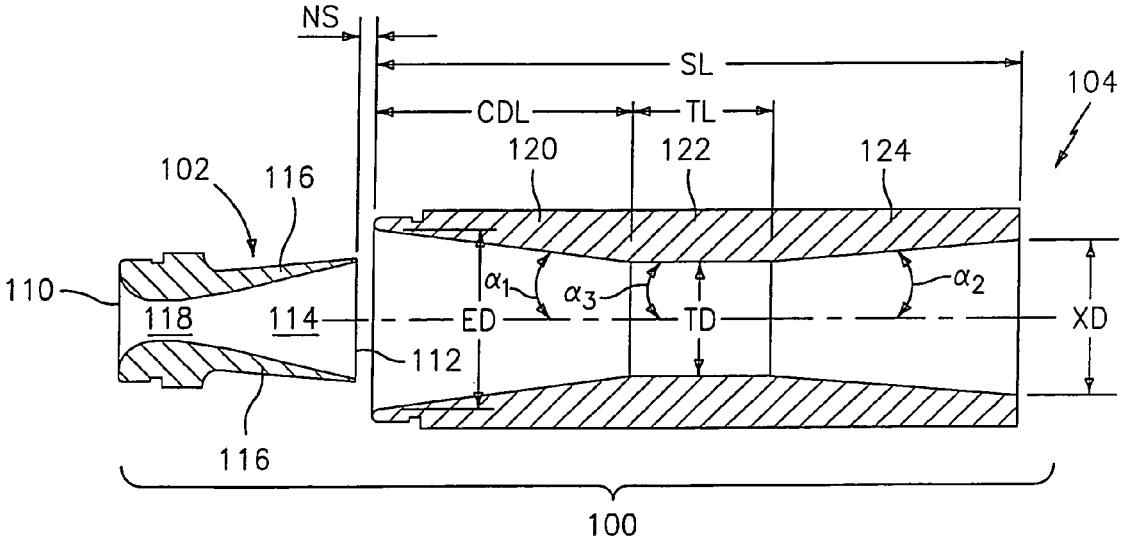
FIG. 3 is a cross-sectional view of a lobed, convergent/divergent, supersonic nozzle steam ejector or vacuum system according to the present invention.
Figure 6:
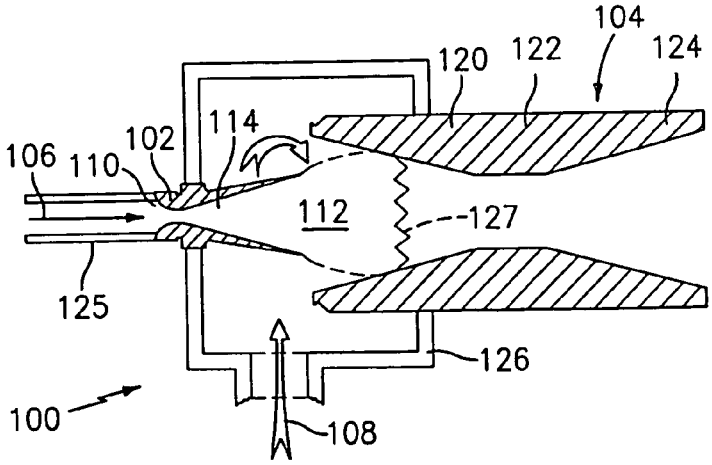
FIG. 6 is a schematic view of how the present ejector system works in a startup mode.

Turning now to FIGS. 6–8C, an explanation of the ejector system 100 as a whole will now be given. FIG. 6 shows how the ejector 100 works upon startup. First, as the pressure at the shroud exit is decreased, the primary flow 106 is directed through the primary nozzle 102, e.g., a pressurized stream of air or steam is directed to the fore or entrance end of the primary nozzle via a supply line or duct 125. The primary flow 106 is choked by the nozzle 102 and becomes supersonic as it passes through the nozzle divergent section. Then, the primary flow (now lobe-shaped) leaves the nozzle 102 and continues to expand supersonically in the ejector shroud 104. As the primary flow 106 expands it entrains the secondary flow 108 and drags it along through the system. As should be appreciated, the secondary flow passes into the shroud via an annular gap (or some other type/shape of space or opening) between the nozzle 102 and shroud 104, which, of course, may be provided in conjunction with a guidance pathway or housing 126, similar to what is shown in FIG. 2. Subsequently, a normal shockwave 127 occurs at the maximum flow area of the combined flow at some starting shroud exit pressure. As the pressure at the exit of the shroud 104 is further decreased, the shockwave will move through the shroud throat 122 and into the subsonic diffuser 124. The system is then started, with the flow being supersonic from the lobed nozzle throat 118 to the shroud throat 122. In this "run" mode, large vacuums can be generated.

This starting phenomena (and run condition) is similar to the operation of a supersonic wind tunnel, as long as the secondary flow is mixed quickly and efficiently with the primary flow. However, conventional round nozzles (in conventional ejector systems) do not accomplish this. Instead, the low energy secondary flow remains on the outside of the primary flow, causing flow reversal in the shroud diffuser portions. This flow reversal reduces both the ejector system's maximum suction pressure and the load flow rates.

Figure 7:
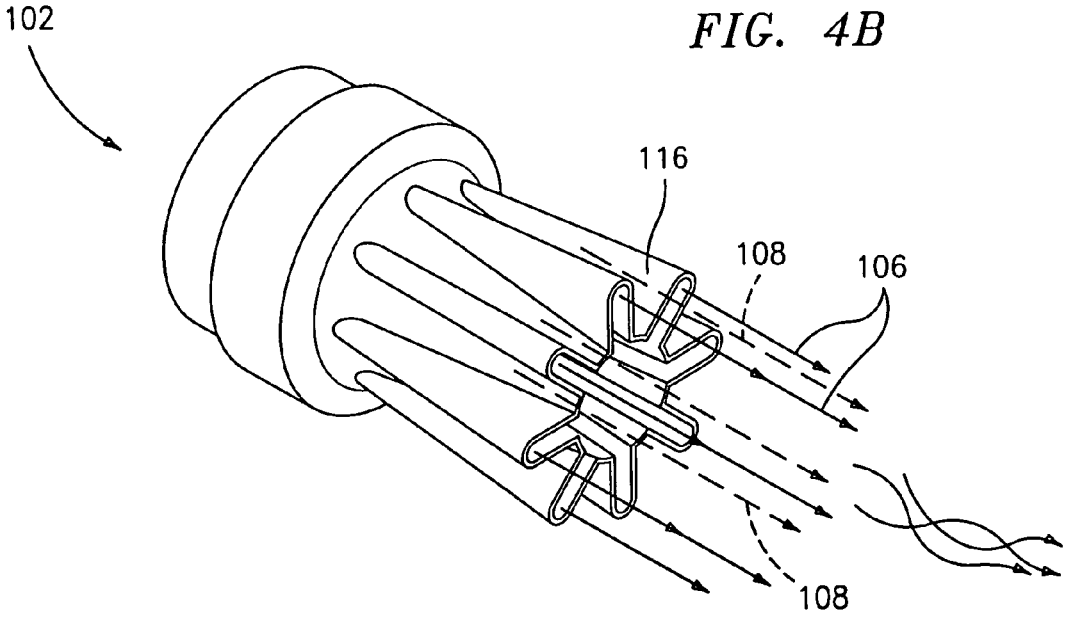
FIG. 7 is a perspective view of the primary nozzle showing how primary and secondary flows pass over/through the lobed primary nozzle and are rapidly mixed.
Figure 4C:
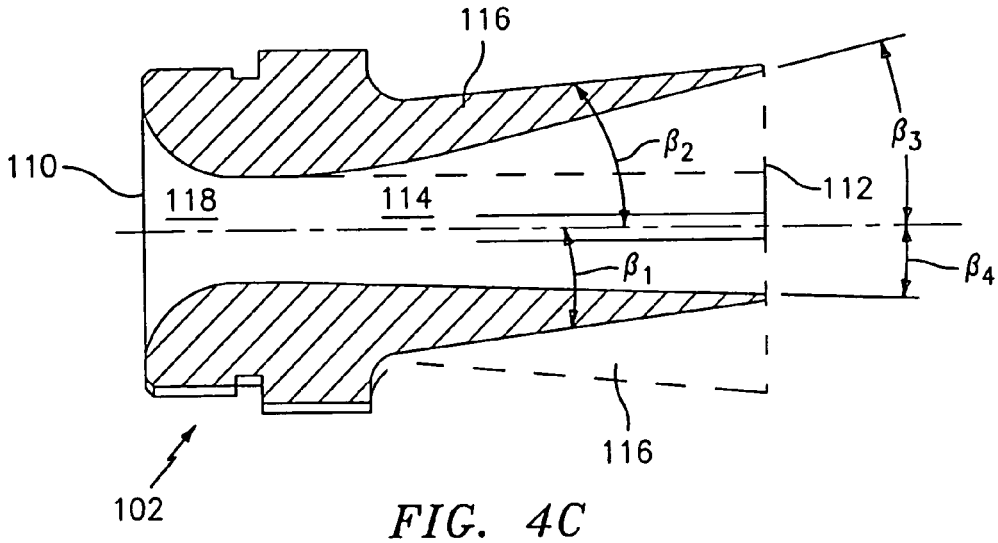
FIG. 4C is a second cross-sectional view, taken along lines 4C—4C in FIG. 4D, of the lobed primary nozzle.
Figure 4D:
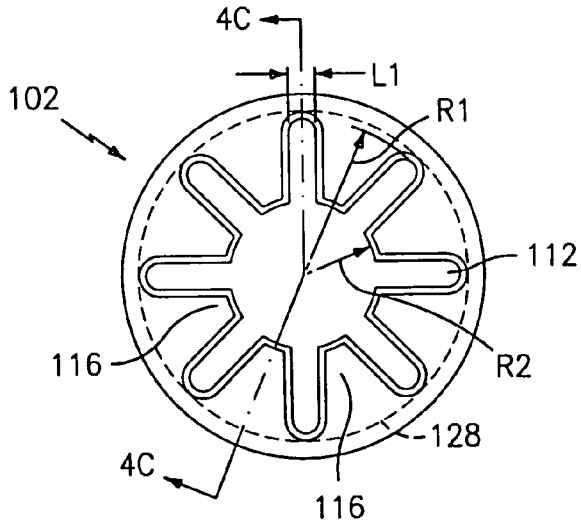
FIG. 4D is an exit-end view of the primary nozzle showing the nozzle's convergent/divergent lobes.

Fortunately, the lobed primary nozzle 102 eliminates this problem. In particular, in addition to the features/characteristics noted above, the lobe contours assure minimal supersonic flow loss in the nozzle. Also, the round area encompassing all the lobes at the exit plane (circular perimeter 128 defined by the tops of all the lobes at the exit, see FIG. 4D) has a flow area close to (i.e., substantially the same as) the primary flow expansion area needed to generate the desired run suction pressure. Accordingly, most of the secondary, load flow 108 will flow between the lobes 116, as shown in FIG. 7. Thus, the secondary flow 108 is entrained (pulled) from two sides. This causes rapid mixing and an ability to flow through a larger pressure rise without separating.

Once the combined flow enters the ejector shroud 104, the diffuser regions 120, 124 decelerate the combined flow while increasing the flow pressure. Typically, in conventional diffusers the inner wall angles are not more than 7° to avoid flow separation ("wall angles" are the degree of tapering, i.e., angles with respect to a center axis, of a shroud's inner walls—see, e.g., angles $\alpha_1$, $\alpha_2$, and $\alpha_3$ in FIG. 3). Flow separation is when the flow leaves the diffuser wall and creates reversed flow regions or vortices, as typically happens where there is a growing boundary layer and an increase in pressure. These reversed flow vortices drain energy from the flow and greatly reduce the pressure recovery of the diffuser. In the present ejector system 100, the lobed nozzle 102 energizes the boundary layer on the inside wall of the ejector shroud, therefore allowing for much steeper diffuser wall angles. In fact, angles between 7° and about 20° have been found workable according to the present invention, as shown in the ejector shroud 104 in FIG. 5. This is also shown schematically in FIG. 8A. There, at region 8B, the velocity profile (shown in FIG. 8B) indicates that the low velocity, low energy secondary flow 108 is near the wall of the shroud 104. At region 8C, the velocity profile (shown in FIG. 8C) indicates that the lobed primary flow 106 impinges on the wall of the shroud 104 and energizes the boundary layer flow 130 to reduce and/or eliminate the probability of flow reversal. This boundary layer effect results in a better vacuum performance by the ejector system 100.

As should be appreciated, having steeper inner wall angles (70 and above) allows the ejector system to be shorter and/or more compact, while inner wall angles above about 20° are generally too steep to avoid flow separation (and associated performance loss) even with the beneficial effects of the lobed primary nozzle 102. However, depending upon the particular application and particular configuration of the lobed primary nozzle and ejector shroud, inner wall angles in the ejector shroud above about 20° may be possible and/or desirable.

Figure 9:
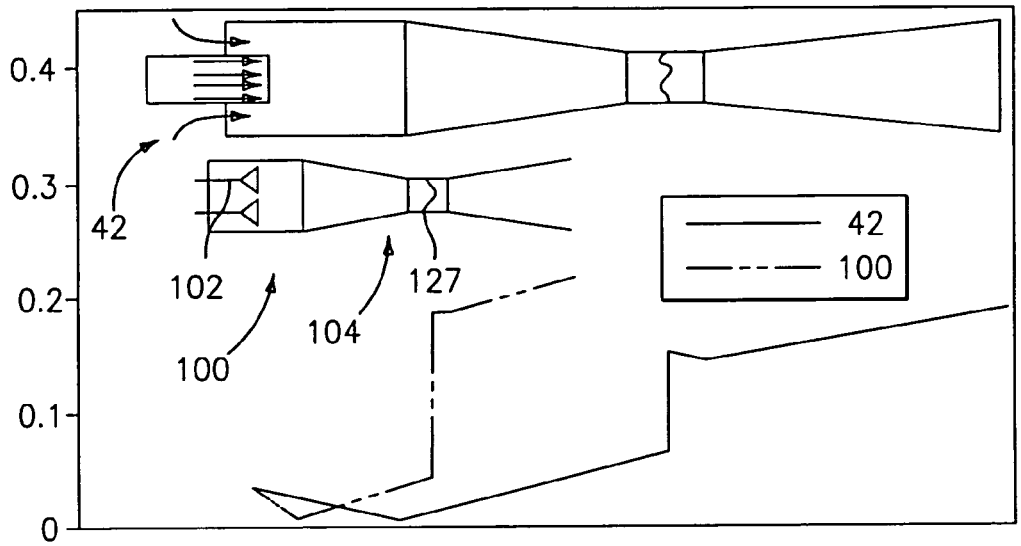
FIG. 9 is a graph of pressure versus ejector length comparing the present ejector system to a conventional ejector system.
Figure 10:
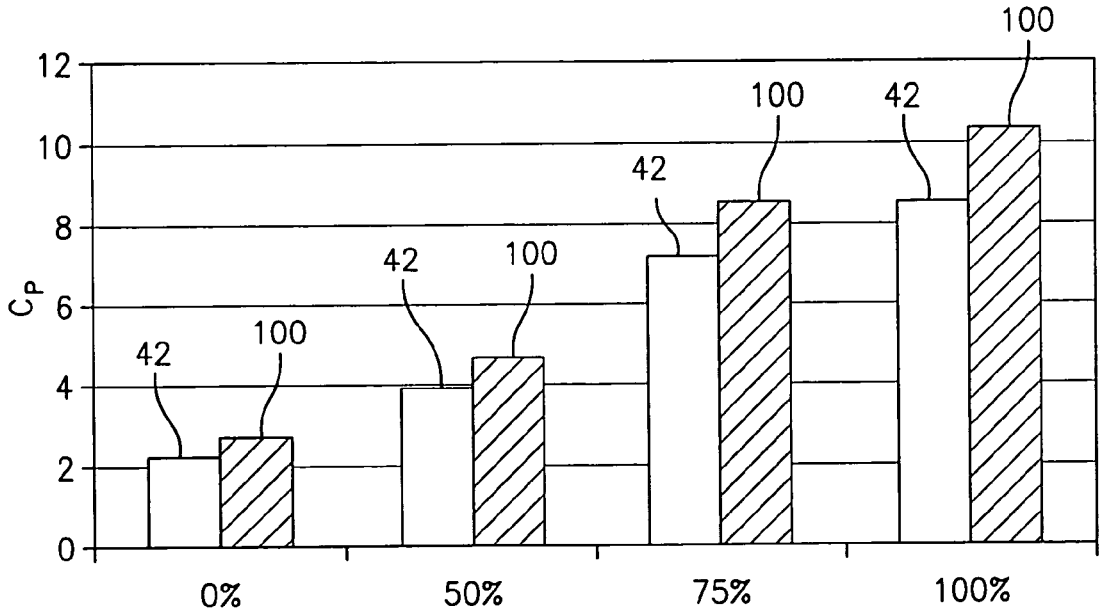
FIG. 10 is a bar graph of pressure coefficient versus secondary flow blockage percentage, comparing the present ejector system to a conventional ejector system. The pressure coefficient is a non-dimensional parameter reflecting the pressure rise through the ejector system.

FIGS. 9 and 10 show various test results indicating enhanced performance by the ejector system 100, even though the ejector system 100 has a significantly smaller SLED ratio than existing ejector shrouds. More specifically, FIG. 9 shows a graph (generated via a computerized mathematical model and validated experimentally) of shroud pressure versus length comparing the present system 100 to a typical ejector 42, where the x-axis is the length of the ejector and the y-axis is the pressure (in psi). As can be seen, the present ejector system 100 has a larger discharge pressure than the existing system 42. This is because of the overall operation of the ejector system 100, and because shroud wall friction affects the shorter shroud 104 less, thereby reducing the Mach number of the supersonic diffuser 120 less dramatically than conventional ejectors—friction tends to slow a supersonic flow, thereby reducing its Mach number, and accelerate a subsonic flow (the Mach number in this context is the speed of air at a particular location divided by the speed of sound). With a higher Mach number, the shroud will accommodate a larger normal shockwave, which means a larger pressure increase. Moreover, in the subsonic diffuser 124, the friction does not accelerate the flow as much as it does in conventional LD systems. This lower speed (and associated Mach number) results in a further rise in pressure.

FIG. 10 shows a comparison between the pressure coefficients ($C_p$) of the present ejector system 100 and a conventional ejector system 42 at different levels of secondary flow blockage (indicated along the x-axis). The pressure coefficient represents a measure of the suction pressure generated by the system, with a larger pressure coefficient being better. Additionally, a 0% secondary flow blockage indicates that the secondary flow is fully free to enter the ejector shroud, while a 100% blockage indicates that the secondary flow is completely blocked off or prevented from entering the ejector shroud. As indicated, the present ejector system 100 has a higher $C_p$ at each blockage level, indicating substantially better performance over existing systems, even with a smaller SLED ratio.

Although the ejector system of the present invention has been illustrated as having a lobed nozzle and an ejector shroud each with a particular design/shape, one of ordinary skill in the art will appreciate that the design and/or shape could be altered, within the teachings of the invention, without departing from the spirit and scope of the invention. For example, as mentioned above, the ejector shroud can have different SLED ratios—between about 1.0 and about 3.5 (according to testing), or even more in applications where the ejector system can be longer. Also, the lobed nozzle can have a different number of lobes, and can have differently-shaped lobes, as long as they provide a suitable mixing/flow operation within the context of a shortened ejector system.

Although the ejector system of the present invention has been generally illustrated as having an annular space between the primary nozzle and ejector shroud for admitting the secondary flow, it should be appreciated that other types of spaces or openings could be provided for admitting the secondary flow. For example, the nozzle and ejector shroud could actually be connected via a conical skirt or the like, which would be provided with holes or perforations for admitting the secondary flow. Thus, language characterizing the nozzle as being, e.g., "spaced apart from" the ejector shroud, or the nozzle and shroud "having a space there between," should be construed as including any type of opening for admitting a secondary flow.

Since certain changes may be made in the above described ejector system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Having thus described the invention, what is claimed is:

1. An ejector system comprising:

a. a convergent/divergent nozzle adapted in size and shape to supersonically accelerate a primary flow passing through the nozzle, and b. an ejector shroud generally coaxial with the nozzle, said nozzle and ejector shroud having a space there between for admitting a secondary flow;

c. wherein the convergent/divergent nozzle includes a plurality of lobes for mixing the primary flow with the secondary flow, said lobes having a lobe wall contouring in the divergent area region of the nozzle for enhancing both the nozzle flow expansion and the mixing of the primary flow with the secondary flow, and d. wherein the ejector shroud is adapted in size and shape to decelerate and increase the flow pressure of the mixed primary and secondary flows passing through the ejector shroud, said shroud having a length to entrance diameter ratio from about 1 to about 3.5.

2. The ejector system of claim 1 wherein the ejector shroud has a length to entrance diameter ratio of about 3.5.

3. The ejector system of claim 1 wherein the ejector shroud has an inner wall with an inner wall angle between 7° and about 20°.

4. An ejector system comprising:

a. a convergent/divergent nozzle adapted in size and shape to supersonically accelerate a primary flow passing through the nozzle, and b. an ejector shroud generally coaxial with the nozzle, said nozzle and ejector shroud having a space there between for admitting a secondary flow;

c. wherein the convergent/divergent nozzle includes a plurality of lobes for mixing the primary flow with the secondary flow, said lobes having a lobe wall contouring in the divergent area region of the nozzle for enhancing both the nozzle flow expansion and the mixing of the primary flow with the secondary flow; wherein:

i. the lobes define an exit area of the nozzle; and ii. the exit area has a flow area substantially the same as a primary flow expansion area needed to generate a desired run suction pressure for the ejector system, whereby the secondary flow is caused to flow between the lobes for rapid mixing and passing through a larger pressure rise without separations; and d. wherein the ejector shroud is adapted in size and shape to decelerate and increase the flow pressure of the mixed primary and secondary flows passing through the ejector shroud.

5. An ejector system comprising:

a. a convergent/divergent nozzle adapted in size and shape to supersonically accelerate a primary flow passing through the nozzle, and b. an ejector shroud generally coaxial with the nozzle, said nozzle and ejector shroud having a space there between for admitting a secondary flow;

c. wherein the convergent/divergent nozzle includes a plurality of lobes for mixing the primary flow with the secondary flow, said lobes having a lobe wall contouring in the divergent area region of the nozzle for enhancing both the nozzle flow expansion and the mixing of the primary flow with the secondary flow, and d. wherein the ejector shroud is adapted in size and shape to decelerate and increase the flow pressure of the mixed primary and secondary flows passing through the ejector shroud, said shroud having a plurality of inner walls each having an inner wall angle, wherein the inner wall angle of at least one of the inner walls is between 7° and about 20°.

6. An ejector system for creating a low pressure and/or vacuum region by entraining a secondary flow with a primary flow, said ejector system comprising:

a. a convergent/divergent nozzle adapted in size and shape to supersonically accelerate the primary flow passing through the nozzle and to mix the primary flow with the secondary flow, wherein the nozzle includes a plurality of lobes for mixing the primary flow with the secondary flow, said lobes having a lobe wall contouring in a divergent area region of the nozzle for enhancing both the nozzle flow expansion and the mixing of the primary flow with the secondary flow; and b. diffuser means generally coaxial with and spaced apart from the nozzle means to admit the secondary flow, said diffuser means for decelerating and increasing the flow pressure of the mixed primary and secondary flows, wherein the diffuser means is an ejector shroud having a length to entrance diameter ratio from about 1 to about 3.5.

7. The ejector system of claim 6 wherein the diffuser means is an ejector shroud having a length to entrance diameter ratio of about 3.5.

8. The ejector system of claim 6 wherein:

a. the plurality of lobes define an exit area of the nozzle; and b. the exit area has a flow area substantially the same as a primary flow expansion area needed to generate a desired run suction pressure for the ejector system, whereby the secondary flow is caused to flow between the lobes for rapid mixing and passing through a larger pressure rise without separation.

9. The ejector system of claim 8 wherein;

a. the diffuser means is an ejector shroud having a plurality of inner walls each having an inner wall angle; and b. the inner wall angle of at least one of the inner walls is between 7° and about 20°.

10. The ejector system of claim 6 wherein the diffuser means is an ejector shroud having an inner wall with an inner wall angle between 7° and about 20°.

11. An ejector system comprising:

a. a convergent/divergent nozzle configured to supersonically accelerate a primary flow passing through the nozzle; and b. an ejector shroud generally coaxial with the nozzle, said nozzle and said ejector shroud having a space there between for admitting a secondary flow;

c. wherein the nozzle comprises a plurality of lobes for mixing the primary flow with the secondary flow, said lobes having a lobe wall contouring in a divergent area region of the nozzle for enhancing both the nozzle flow expansion and the mixing of the primary flow with the secondary flow, and d. wherein the ejector shroud is configured to decelerate and increase the flow pressure of the mixed primary and secondary flows passing through the ejector shroud, wherein the ejector shroud has a length to entrance diameter ratio from about 1 to about 3.5.

12. The ejector system of claim 11 wherein the ejector shroud has a length to entrance diameter ratio of about 3.5.

13. The ejector system of claim 11 wherein:

a. the ejector shroud has a plurality of inner walls each having an inner wall angle; and b. the inner wall angle of at least one of the inner walls is greater than 7°.

14. The ejector system of claim 11 wherein;

a. the ejector shroud has a plurality of inner walls each having an inner wall angle; and b. the inner wall angle of at least one of the inner walls is between 7° and about 20°.

15. The ejector system of claim 11 wherein the ejector shroud has an inner wall with an inner wall angle between 7° and about 20°.

16. The ejector system of claim 11 wherein a round area encompassing all the lobes at an exit plane of the nozzle has a flow area sufficient to generate a desired run suction pressure for the ejector system.

17. An ejector system comprising:

a. a nozzle configured to supersonically accelerate a primary flow passing through the nozzle; and b. an ejector shroud generally coaxial with the nozzle, said nozzle and said ejector shroud having a space there between for admitting a secondary flow; wherein:

c. the nozzle comprises a plurality of lobes for mixing the primary flow with the secondary flow;

d. the ejector shroud is configured to decelerate and increase the flow pressure of the mixed primary and secondary flows passing through the ejector shroud; and e. the ejector shroud has a length to entrance diameter ratio from about 1 to about 3.5.

18. An ejector system comprising:

a. a nozzle configured to supersonically accelerate a primary flow passing through the nozzle; and b. an ejector shroud generally coaxial with the nozzle, said nozzle and said ejector shroud having a space there between for admitting a secondary flow; wherein:

c. the nozzle comprises a plurality of lobes for mixing the primary flow with the secondary flow;

d. the ejector shroud is configured to decelerate and increase the flow pressure of the mixed primary and secondary flows passing through the ejector shroud;

e. the ejector shroud has a plurality of inner walls each having an inner wall angle; and f. the inner wall angle of at least one of the inner walls is greater than 7°.

* * * * *